United States Patent [19]

Gress

[11] Patent Number: 4,717,284

[45] Date of Patent: Jan. 5, 1988

[54] DEVICE FOR DRAINING SOILS IN DEPTH

[75] Inventor: Jean-Claude Gress, Fontaines, France

[73] Assignee: Hydrogeo S.A., Fontaines, France

[21] Appl. No.: 30,147

[22] Filed: Mar. 25, 1987

[51] Int. Cl.[4] ..... E02B 11/00

[52] U.S. Cl. ..... 405/50; 137/142; 404/2; 405/36; 405/43

[58] Field of Search ..... 405/50, 41, 42, 44, 405/47, 48, 40, 39, 46, 43, 36, 37; 137/123, 132, 142; 166/268, 266, 52, 54; 404/2

[56] References Cited

U.S. PATENT DOCUMENTS

| | | | |
|---|---|---|---|
| 100,786 | 3/1870 | Moyer | 137/142 X |
| 205,779 | 7/1878 | Worthen | 166/52 |
| 301,391 | 7/1884 | Reinecke | 137/142 X |
| 424,196 | 3/1890 | Hallock | 405/39 X |
| 1,151,608 | 8/1915 | Paech | 405/50 |
| 1,286,666 | 12/1918 | Layne | 405/50 X |
| 1,878,295 | 9/1932 | Richmond | 405/36 |
| 2,142,376 | 1/1939 | rodgers | 166/54 |
| 2,176,540 | 10/1939 | Moore | 166/54 X |
| 2,654,434 | 10/1953 | Culleton | 166/54 X |
| 2,959,184 | 11/1960 | Mahan | 137/142 X |
| 3,021,860 | 2/1962 | Gandy | 405/40 X |
| 3,079,939 | 3/1963 | LaPray | 405/36 X |
| 3,750,691 | 8/1973 | Lidolph | 137/142 |
| 4,180,348 | 12/1979 | Taylor | 405/51 X |
| 4,222,520 | 9/1980 | Melcher | 405/36 X |
| 4,260,284 | 4/1981 | Huart | 405/50 X |

FOREIGN PATENT DOCUMENTS

| | | | |
|---|---|---|---|
| 389645 | 3/1933 | United Kingdom | 137/142 |
| 289166 | 8/1971 | U.S.S.R. | 405/40 |

*Primary Examiner*—Dennis L. Taylor

*Attorney, Agent, or Firm*—Collard, Roe & Galgano

[57] ABSTRACT

A device is provided for draining ground in depth. Each drain includes a tube having perforations in its middle part (1) with solid walls and closed at its lower part so as to form a cup (2), and with solid walls and open at its upper part (4). A siphoning tube (6) is permanently immersed by its lower part (3) in the cup (2), rises inside the tube (1) and leaves through a side duct (5) to drop down again towards an outlet (8). The outlet (8) is at the same level as the upper edge of the cup (2) so that the end (3) of the pipe (6) is always immersed and so that the siphon cannot be unprimed even during a dry period and requires no intervention.

7 Claims, 2 Drawing Figures

DEVICE FOR DRAINING SOILS IN DEPTH

The present invention relates to a device for draining soils in depth, by siphoning off the water collected by one or more drains placed in the ground.

Traditionally, draining is carried out either by pumping by means of filtering tips connected to a vacuum pump or by means of wells provided with pumps, or by gravitational discharge when it is possible through subhorizontal draining, draining trenches, walls or spurs, the water being pumped if need be in the case of trenches or walls if gravitational discharge is not possible.

These solutions also have serious drawbacks. Thus, pumping is subjected to the constraints of the necessary user device. Subhorizontal drains raise problems of accessibility to the drilling equipment, because of the required slope and because of the subhorizontal position, penetration of the water bearing formation is inefficient and, furthermore, the sliding surfaces of the ground cut these drains which are sheared.

Draining trenches can only be considered for a maximum depth of 4 m. Draining walls, variants of trenches, require a setting up technique equivalent to that of molded walls and are therefore very expensive and the draining spurs have a very limited efficiency.

In the Pat. No. FR 737 965, without an example being shown or even truly described, it has been considered substituting for subhorizontal drains, when drilling thereof presents too many difficulties, vertical drains or holes which are drained off by siphoning. The siphons, mentioned, for priming thereof, must end in valves, allowing water to leave but not allowing air to enter and the priming, or repriming, requires connection to a water or vacuum pump suction device and, when the draining has reached a certain degree, the siphon is automatically unprimed and must be reactivated regularily (daily) by operators having portable or fixed hand pumps, unless a motor driven pumping device is permanently installed for pumping operation. This technique results in an alternation of rising and dropping water levels, which goes counter to the desired stability of the ground. Furthermore, since the draining holes to be siphoned must be situated in very different sites, often difficult of access, the equipment and staff requirements for trouble shooting and supervision are considerable, therefore this technique has been abandoned in favor of the above mentioned solutions, relatively less expensive despite their very high cost.

The present invention aims at overcoming the drawbacks of the prior art which have just been discussed by providing a siphoning draining device capable of operating permanently and independently without risk of being unprimed, and therefore requiring no repeated servicing or systematic supervision.

Figure 1:
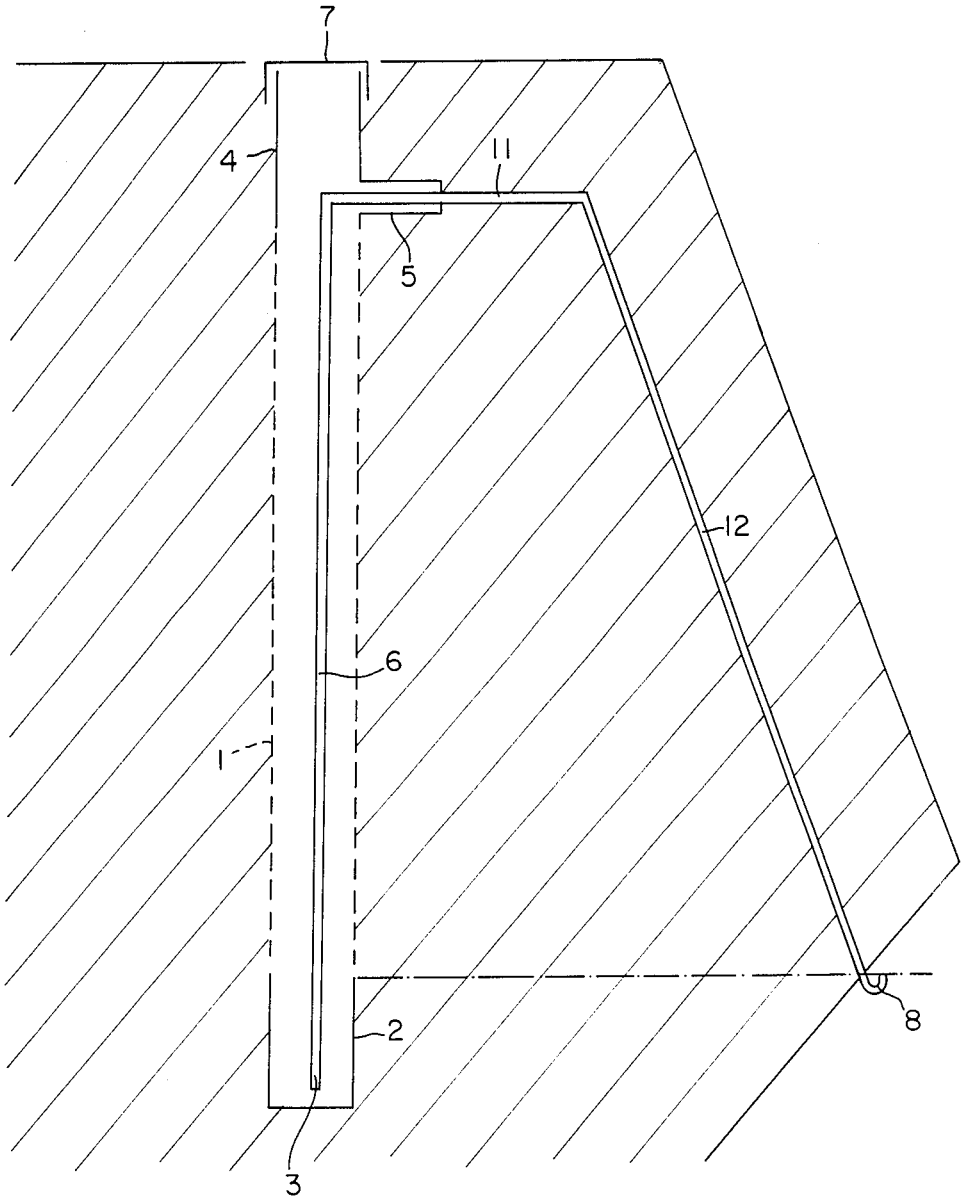
Figure 2:
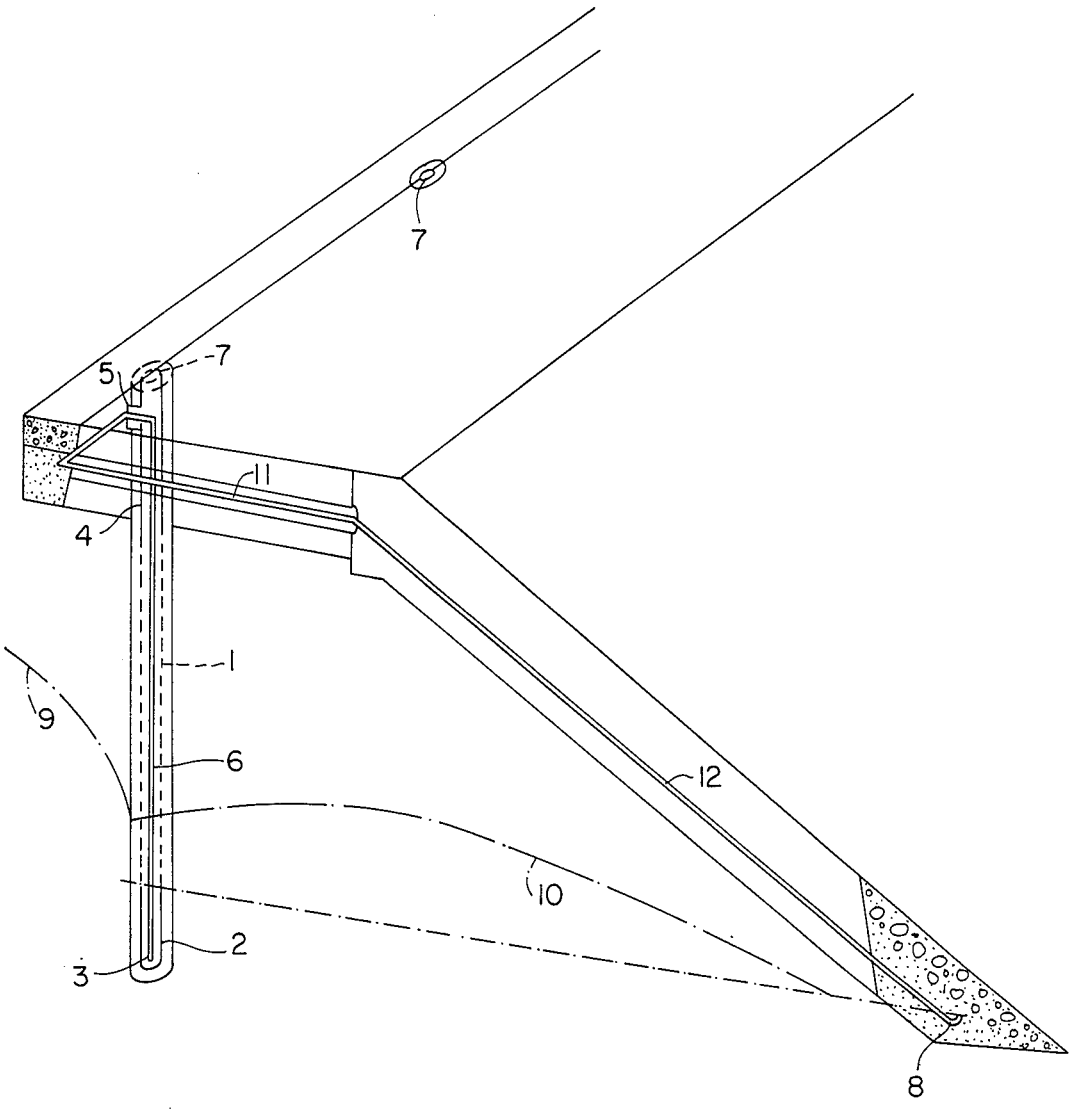

The characteristics of the invention which form the subject matter of the claims and certain advantages wil be clear from the following description and, for better understanding of which, reference is made to the drawings, in which:

FIG. 1 illustrates very schematically in section the principle of a drain-siphon device of the invention, and FIG. 2 shows in section and perspective an example of setting up the device of the invention for draining upstream of a road on a sloping site.

In what follows, the invention will be described by taking the example of draining the upstream side of a road on a sloping side where the ground is likely to slide. It is clear that this example is in no wise limitative and that the invention may find its applicaiton in many other cases as will be clear to a man skilled in the art.

The drain of FIG. 1 is vertical, but any slope from the vertical to the horizontal is possible without the operating principle thereof being changed. The drain is either placed in a previously bored hole, or beaten, vibrated or gassed in accordance with known techniques. It is essentially formed by a tube, made for example from a plastic material appropriate for its use. This tube has over the largest part of its length a perforated part 1 forming a strainer and representing, by its function, the drain properly speaking. At its lower end, it is closed and its walls are solid so as to form a cup or reservoir 2. At the top it has a tubular part with solid walls 4 open upwardly. This upper part 4 further includes at least one side duct 5 and emerges at the top in an inspection cavity, closed as is usual by a lid 7, forming advantageously a manhole with conventional key. The infiltration water coming from the upstream water bearing layer 9 (FIG. 2) penetrates into the drain through the filter part 1 and fills it up to a certain level higher than the upper edge of cup 2 while lowering the level of the layer (referenced 10) downstream.

In the tube, a siphoning pipe 6 is permanently immersed by its lower end 3 in cup 2, rises inside the drain and leaves through the side duct 5 and, after a possible intermediate section 11 which may be substantially horizontal, for crossing the road, drops down to an outlet at its end 8 situated in altitute at the level of the upper edge of cup 2 so that the siphon effect may take place without this cup 2 being emptied by the siphoning effect.

Considering the atmospheric pressure, the pressure losses in the siphoning tube 6, and other cavitation and degassing phenomena, attention should be paid, for reliable operation, that the differences of altitude between the highest point of tube 11 and respectively the upper level of cup 2 and the outlet end 8, or the level of water of a well or basin where this end 8 might be, does not exceed 9 m.

From the foregoing, it is clear that, with the end 3 of the siphon tube 6 constantly immersed in the cup 2 which can never be emptied, the siphon can in no case be unprimed from this side, even when the level of the layer 9, 10 has been lowered to the level of the upper edge of cup 2, or when, during a dry period, it has fallen to a lower level. In this case, the siphon will obviously be no longer active since there will no longer be any water to drain, but will automatically resume its activity as soon as new infiltrations into the drain occur and as soon as the level of water tends to rise.

Since there exists a problem of air being drawn into the siphon tube 6 through its outlet end 8, this problem may be avoided by giving this end 8 a raised form, for example in the shape of a crook as shown in the drawings. Similarly, this end 8, still placed at a site where the topography provides the required difference of level, as mentioned above may be disposed in a well of known type such as an overflow well or in a sump pit whose level may be maintained if required by conventional pumping.

As already mentioned above, cavitation and degassing phenomena could under extreme conditions, occur in the siphon tube 6 and generate pockets at the top part thereof and adversely affect the correct operation. These phenomena depend for a large part on the internal surface condition of the siphon tube 6 and on the siphoning rate. Therefore, pipes will be preferably used made from plastic material for example of the type known under the name RILSAN which seem to give excellent results.

Furthermore, depending on the underground water conditions proper to the soil, the siphon may be doubled or tripled by means of tubes mounted in parallel side by side but of different diameters, one making up for the other depending on the local and/or momentary circumstances.

Advantageously, in addition, the siphon tube or tubes, will be housed, from their exit from the drain through the side duct 5, i.e. in the intermediate part 11 and the downgoing part 12, in a protective sheath itself protected in a trench by conventional sand fixing. The depth of burial in the trench, as well as the depth of the side ducts 5 or of the outlet 8 with respect to the ground surface, will be sufficient so as to form a protection against freezing.

It will be noted that the technique which has just been described allows drains to be used in an isolated manner, or in parallel towards a common outlet, possibly in an overflow well or else, in cascade, an upstream drain being siphoned into a downstream drain, these assemblies being possible combined in any locally appropriate manner, including incorporation with conventional subhorizontal drains.

As already mentioned, there is also residual water level in cup 2, which prevents the siphon from being unprimed and brings it back into flow as soon as infiltrations occur causing this level to rise.

For the first priming, three solutions are possible:the drain is filled with make up water as far as a level higher than the highest point of the siphon tube 6, or else suction may be applied to the outlet 8 of the siphon or, preferably, water can be injected from the outlet 8, which has the advantage of driving out all the air present in the siphon.

When the siphon drains of the invention are placed in the ground during a dry period, they may be immediately primed by filling, as already mentioned, and they will be ready to start flowing without any intervention as soon as, during a wet period, the level of the water layer has rise above that of the upper edge of cups 2, which is a considerable advantage with respect to the conventional siphoning technique.

I claim:

1. A device for draining ground in depth by siphoning off the water collected by drains placed in the ground, characterized by the fact that each drain includes a tube with perforations in its middle part (1) having solid walls and closed at its lower part so as to form a cup (2) and with solid walls and open at its upper part (4), this upper part (4), being provided with a side duct (5), at least one siphoning pipe (6) being permanently immersed by its lower end (3) in the cup (2), rising up through the inside of the tube (1) and leaving through the side duct (5) to drop down again (11, 12) towards an outlet (8) situated, in altitude, at the level of the upper ege of the cup (2).

2. The device according to claim 1, characterized by the fact that the upper part (4) of the drain has provided thereover a lid forming a manhold (7).

3. The device according to claim 1 characterized by the fact that the outlet end (8) of the siphoning pipes (6, 11, 12) is raised in the form of a crook.

4. The device according to claim 1 characterized by the fact that the outlet end (8) of the siphoning pipe bathes in a sump pit or overflow well.

5. The device according to claim 1 characterized by the fact that the difference of altitude between the highest point of the siphoning pipe (6) and respectively the upper edge of the cup (2) and the outlet (8) is at most equal to 9 m.

6. The device according to claim 1 characterized by the fact that, for the same drain, it has several siphoning pipes (6) of different diameters.

7. The device according to claim 1 characterized by the fact that the part of this siphoning pipe or pipes (11, 12) between the side duct (5) and the outlet (8) is housed in a protective sheath.

* * * * *